United States Patent [19]

Martin

[11] 4,364,421

[45] Dec. 21, 1982

[54] WOVEN TEXTILE DRYER FABRIC AND SEAM AND WEAVING METHOD

[75] Inventor: William R. Martin, Greenville, S.C.

[73] Assignee: Wangner Systems Corporation, Greenville, S.C.

[21] Appl. No.: 40,104

[22] Filed: May 18, 1979

Related U.S. Application Data

[63] Continuation-in-part of Ser. No. 829,057, Aug. 30, 1977, abandoned.

[51] Int. Cl.[3] ..... D03D 23/00

[52] U.S. Cl. ..... 139/383 A; 24/33 C; 34/243 F; 198/847; 428/60; 474/255

[58] Field of Search ..... 198/844, 846–847; 139/383 AA, 383 A, 384 R, 383 B; 24/33 C, 33 K, 33 V; 34/243 F, 243 C; 474/255, 258; 428/60–61

[56] References Cited

U.S. PATENT DOCUMENTS 660,027 10/1900 Proctor ..... 198/847

3,735,451 5/1973 Haythornthwaite ..... 74/231 J

*Primary Examiner*—Andres Kashnikow
*Assistant Examiner*—Douglas D. Watts
*Attorney, Agent, or Firm*—Dority & Flint

[57] ABSTRACT

A woven textile fabric and seam is disclosed for joining dryer fabrics and the like papermaking clothing constructed of multiply woven fabric belting wherein each of the ends of the belting is separated into continuous woven superposed plys permitting insertion and securing of seam webbing between the plys at each end of the belting. The seam webbing is illustrated sandwiched between the separated plys and completely enclosed therein when the plys and webbing are secured together so that interruption of the otherwise continuous belting is minimized. Having affixed the webbing at ends of the woven fabric in this manner, pintle loops may be interlaced and fastened securely together by the insertion of pintle material. One of the separated plys may be advantageously woven to provide pintle loops when folded upon itself.

22 Claims, 10 Drawing Figures

Fig. 1.
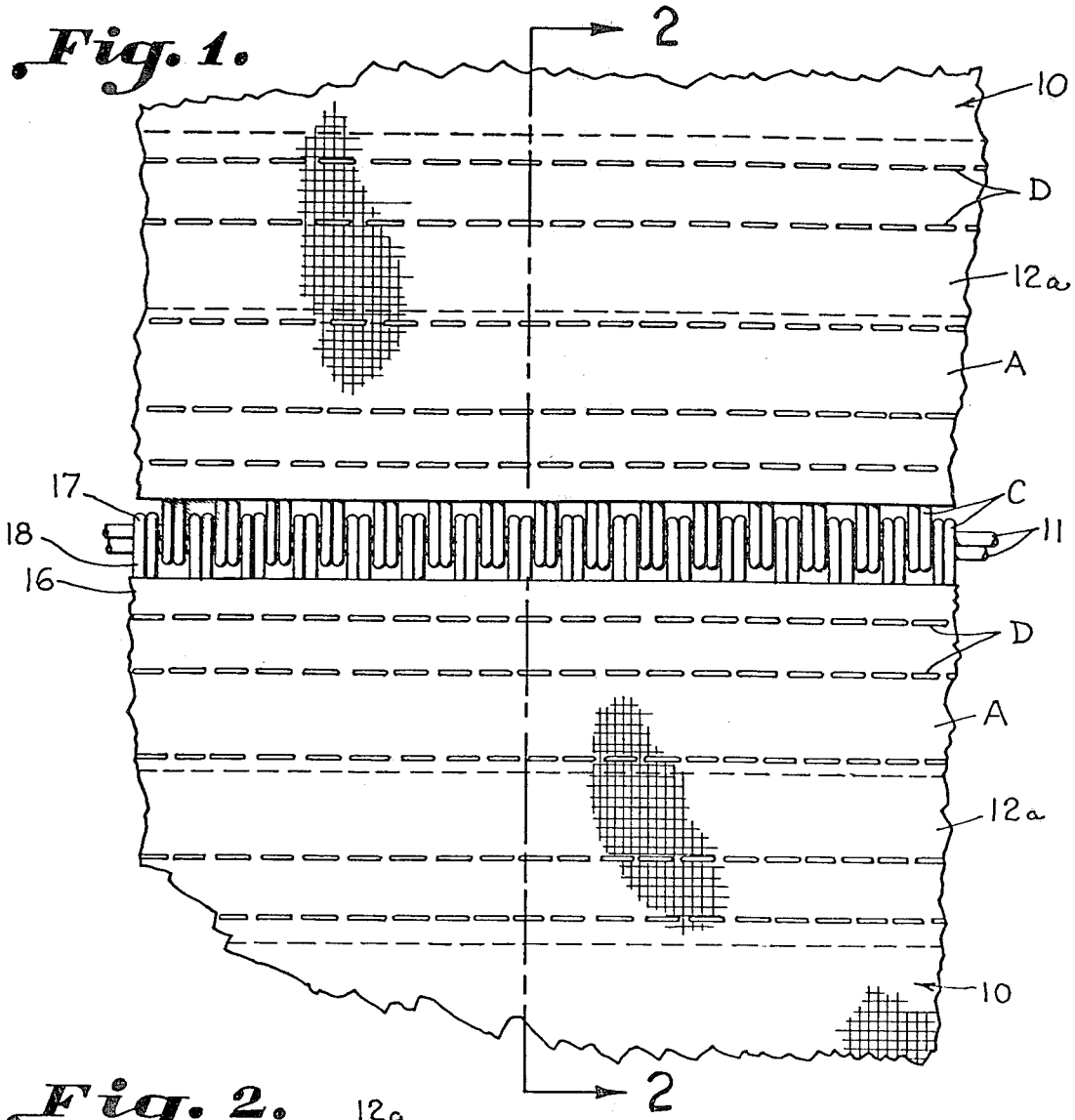
Fig. 2.
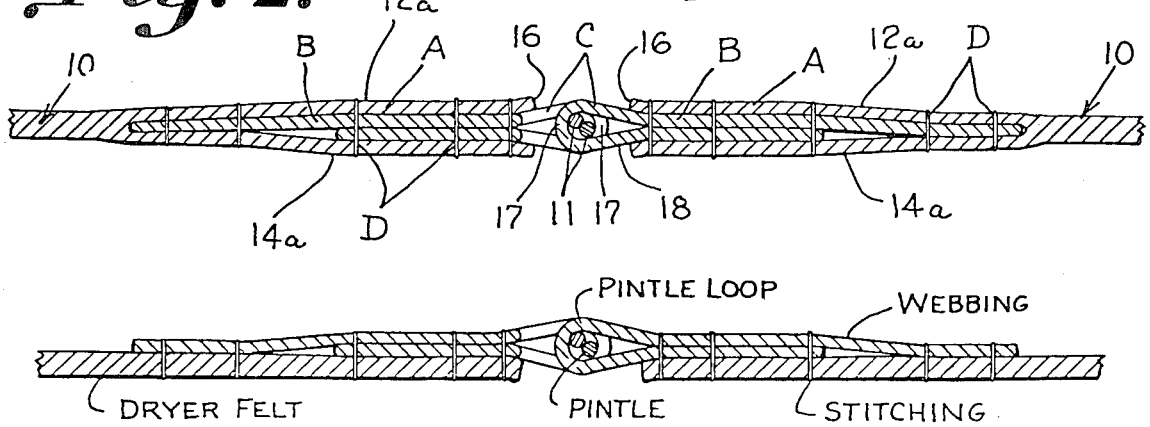
Fig. 2 A. (PRIOR ART)

WOVEN TEXTILE DRYER FABRIC AND SEAM AND WEAVING METHOD

This is a continuation-in-part of applicant's co-pending application entitled Woven Multiply Fabric and Seam, Ser. No. 829,057, filed Aug. 30, 1977, now abandoned.

BACKGROUND OF THE INVENTION

Woven multiply fabrics prepared for use as dryer fabrics or felts are woven completely from one end of the roll to the other with a continuous weave formation. The ends of this fabric may be joined by sewing a suitable pintle seam webbing material across the end width wise. Such webbing customarily has some form of loop or hook configuration on one end which is aligned with the end of the woven fabric and attached as by sewing to one side only of the woven fabric. The webbing may also be joined in such a way that two layers of webbing fit over the end of the woven fabric sandwiching it in between so that all three thicknesses may be stitched together to complete that end of the felt or belt. Another way of joining the belt consists of removing a sufficient number of filling threads to permit folding back warp yarns and hand weaving them back into the body of the fabric thus forming rows of loops for reception of a pintle. U.S. Pat. No. 3,393,115 illustrates a butt spliced joint but such involves substantially increased labor costs.

Felts prepared and joined in the aforementioned conventional ways present problems especially where the webbing is attached by sewing to one side of the woven fabric creating an undesirable lump in the joining area as illustrated in U.S. Pat. Nos. 2,879,580 and 3,335,844. When the fabric is so joined into a belt on the papermaking machine, the joined area constantly strikes the many felt rolls over which it runs causing extra fatigue to set in across the width of the felt creating a bumping and thumping noise problem.

The thickened seam portion of conventional seams bumps when it slaps a roller sending out ripples causing the supported paper to leave the felt and when it returns, a change in the pattern of the paper occurs accompanied by weakened areas. This is particularly unsuitable for fine grade paper.

This condition also places a very heavy strain on the stitching which attaches the webbing to the base fabric since all linear tension pulls from only one side of the felt or belt. This condition causes many felts and belts to come loose from the webbing ruining the felt, which would otherwise be serviceable for an extended period of time, with attendant loss of paper or conveyed stock. With prolonged running time, the exterior thickness of the joined area tends to cause a permanent indention on the face side of the belt or felt which then causes paper sheet marking.

When the webbing is attached equally on both sides of the end of the woven fabric and stitched in this configuration, the noise problem is reduced somewhat, but the fatigue and sheet marking problems are much worse.

The hand woven seam described above has application only on fabrics containing monofilament synthetic warp yarns. Moreover, the procedure for this hand weaving operation is very time and cost consuming and is subject to operator fatigue and error, resulting in the formation of a row of joining loops which have varying yield to load properties.

SUMMARY OF THE INVENTION

It has been found that by utilizing separated fabric plys at the ends of the belt for receiving and affixing the seam webbing, a number of advantages are achieved. Further, it has been found that one of the woven ply extensions may be constructed to include loop forming means whereby the ply extension may be folded upon itself to provide the seam webbing member.

A more balanced fabric thickness, tapered toward connecting pintle wire or a uniform thickness including the connecting seam may be achieved which provides more nearly smooth felt running qualities. Noise is reduced as the felt runs over the many felt rolls, as well as fatigue to the felt or belt and machinery. Paper sheet marking is reduced since there is no appreciable indention. The loop webbing is better protected being inside the ends of the felt, relieving much of the frictional stress previously experienced by the stitching thread as the seam area thumped over the many small diameter felt rolls. Seams constructed in accordance with the invention reduce air turbulence in the dryer pockets because of the gradual tapered effect of the splice. Furthermore, due in part to the reduction in air turbulence, paper sheet flutter is reduced resulting in production of improved quality paper sheet.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein:

FIG. 1 is a plan view illustrating a pintle seam constructed in accordance with the present invention, FIG. 2 is a longitudinal sectional elevation taken on the line 2—2 in FIG. 1, FIG. 2A is a longitudinal sectional elevation similar to FIG. 2, but illustrating a pintle hinge seam constructed in accordance with the prior art.

DESCRIPTION OF A PREFERRED EMBODIMENT

The drawings illustrate a pintle hinge seam for woven multiply dryer fabric and other like clothing used on papermaking machinery such as wet felts and forming fabrics, including separated outer superposed continuous woven ply extensions A forming a terminal sandwich opening outwardly at free outer edges of the dryer fabric. A pintle seam webbing member B is sandwiched between the woven ply extensions at each end of the dryer felt fabric. A row of spaced aligned loops C are carried by and extend outwardly of a free edge of the webbing on each end of the dryer fabric. Stitching means D secure the woven plys at each end of the dryer fabric to respective webbing members with the webbing members between respective plys at each end of the dryer fabric.

Figure 3:
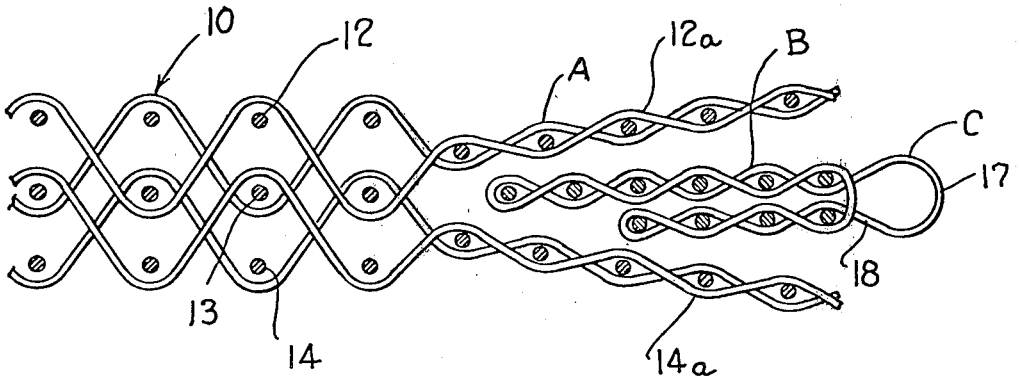
FIG. 3 is an enlarged longitudinal sectional elevation further illustrating a pintle hinge seam constructed in accordance with the present invention.
Figure 4:
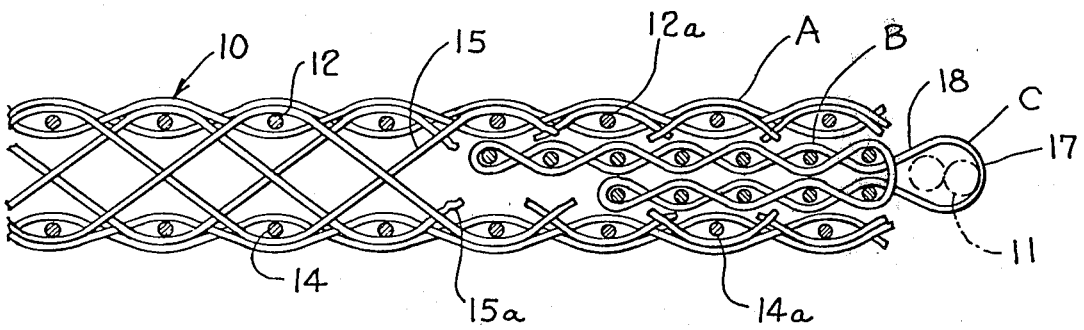
FIG. 4 is a longitudinal sectional elevation similar to FIG. 3 illustrating a pintle hinge seam constructed in accordance with a modified form of the invention.

In manufacturing the dryer fabric or felt illustrated, a loom is set to weave a fabric having fabric belting broadly designated at 10, from a desired yarn. The ends of the felt are to be joined as by pintle materials including loops C and pintle means 11. At the commencement of the weaving operation, a suitable pattern chain may control the harness motion to weave a short length of ply extensions in the form of tubular fabric as illustrated at A. Then the loom is stopped and the pattern chain changed to weave the body of the felt to a predetermined length of belting of the weave pattern specified. FIG. 3 illustrates a three ply fabric having plys 12, 13 and 14. The tubular or ply portion A includes ply extensions 12*a* and 14*a*. When a belt of the desired length is achieved the loom is stopped, the pattern chain is changed back to weave a final length of tubular fabric A. In FIG. 4 a modified form of the invention is shown wherein a two ply fabric is illustrated, the ply extensions A being formed by severing binder yarns 15 as at 15*a*.

The fabric is then doffed from the loom. At the two ends in FIGS. 3 and 4, the excess is trimmed from the ply extensions to allow complete sandwich stitching of the woven seam webbing B, which carries the spaced loops C, across that end of the felt as illustrated at D. The stitching means D preferably comprise a number of spaced rows of yarn stitching at each end as illustrated, but it may comprise other means preferably preserving the permeability of the dryer felt at the hinge seam. The felt is then loaded on the fabric heat setting machine where the ends would be joined with a pintle wire. The usual heat setting and stretching procedures follows.

By reference to FIG. 2, it will be noted that the outer ends of the ply extensions A taper outwardly as at 16 toward the loop portions 17 formed by the outwardly tapering portions 18 into the spaced pintle loops C. Thus, there is no abrupt interruption in the surface of the joint as occurs in dryer felt joints constructed in accordance with the prior art illustrated in FIG. 2A. In accordance with the prior art, the pintle loops and woven webbing which carry same are stitched to one side of the dryer felt so that the entire pintle area forms a discontinuity in the felt having the disadvantages already discussed herein.

Figure 5:
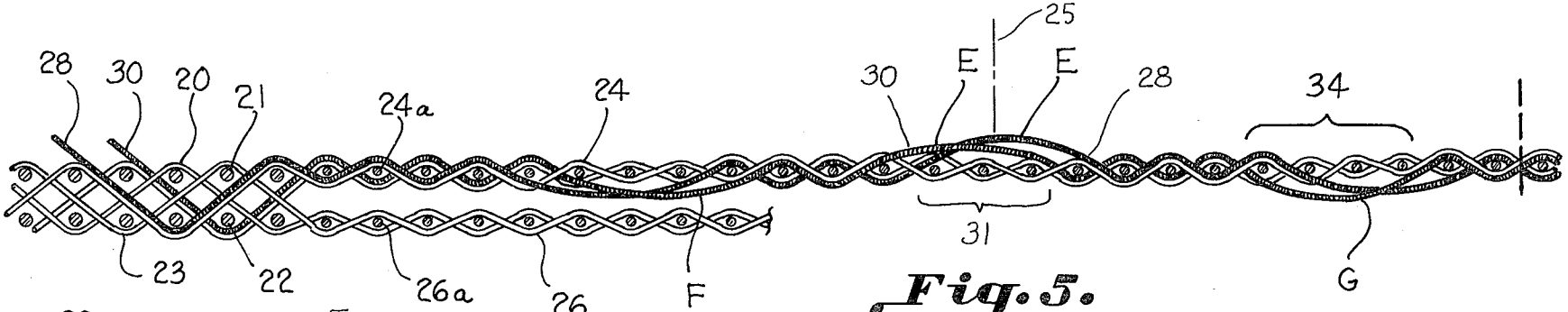
FIG. 5 is an enlarged sectional elevation illustrating an alternate form of a dryer fabric and seam according to the invention.

An alternate embodiment of the invention is illustrated in FIG. 5 wherein one of the woven ply extensions forms the seam webbing and a portion thereof is folded under to provide the seam webbing member inserted between the pair of woven ply extensions. As illustrated, a two ply belting fabric is indicated at 20 which includes a first ply 21 and a second ply 22 in which a plurality of warp strands 23 are interwoven with the filling of the two plys 21 and 22. A pair of separated superposed woven ply extensions are formed at each end of the dryer felt fabric 20 in the form of a first woven ply extension 24 and a second woven ply extension 26. Loop forming means is constructed across the first ply extension 24 intermediate the ends thereof. A row of spaced pintle receiving loops E are defined when the first ply extension 24 is folded upon itself about the loop forming means at a foldline 25 as an intermediate sandwiched layer 27. The loop forming means includes a number of warp strands 28 and 30 floated out of the weave of the first woven ply extension 24 intermediate the ends thereof which form the row of spaced loops E. It will be noted that the warps 28 and 30 are woven in the belting fabric 20 and in the woven ply extension 24 and are preferably different from the regular warps 23. A yarn having a higher tensile strength than the regular warp yarns of the fabric belting portion is advantageous for providing a strong seam. In one application, a braided core yarn such as aramid multifilament yarn with a polymeric coating was utilized. Weave in distances of ½ to 8 inches have been utilized with the longer weave in distances providing a more secure affixation of the loop yarns.

A section 31 of the woven ply extension 24 is cut out beneath the floated loop yarns to enhance the formation of loops E as the ply is folded which will readily receive the pintle member P. The loop warps may be treated with a heat setting resin when the dryer fabric is subjected to the usual heat setting and stretching procedures.

Means for securing the first ply extension 24 in a folded position is provided by a lease yarn 32 interconnecting the warps 28 and 30 which may be hand woven over and under the warps across the entire width of the folded and unfolded ply extension. In further detail, it can be seen that the securing of the folded portion of the first ply extension is provided by forming a pair of longitudinally spaced areas F and G on either side of the loop forming means E in which the loop warps are again floated out of the weave such that when the first ply extension is folded back, the floated out warps overlye one another. A portion 34 of the first woven ply extension is then cut out to provide access for lacing the lease yarn 32 over and under the floated warp yarns from the bottom of the folded back portion of the first ply extension. It will be noted that the lease yarn 32 passes alternately over and under the same loop yarn as it catches it passing through the woven ply and then the folded woven ply. This connection between the folded and unfolded portions of the first ply extension provides a hinge joint by means of which the seam connection made at the loops E between the opposing seam members H and I at the ends of the dryer felt fabric are afforded a degree of lateral and longitudinal flexibility which compensates for any of the rollers of the papermaking machine being out of alignment and enables the belt to run smoothly thereover.

The securing of the folded and unfolded portions of the first ply extensions by means of the lease yarn hinge joint interwoven between the floated warp strands which form the pintle receiving loops also advantageously maintains the loops in a more rigid upright positioning enabling them to maintain their configuration and receive the pintle member P therethrough more readily. A main advantage of this connection between the unfolded and folded portions of the first ply extension and the pintle receiving loops is that seam members H and I are provided which have been found to be stronger than the belting fabric 20 itself. The loops have a greater tensile strength than the regular warp yarns of the belt fabric and the woven ply extensions. Thus, that portion of the dryer felt, the seam webbing, which is usually most susceptible to failure is made stronger resulting in a more efficient and reliable construction.

Stitching yarns may be provided such as at 42 securing the first ply extension, folded portion of the first ply extension, and the second ply extensions of the seam members at each end of the dryer felt. Other folded configurations of the layer 27 may also be utilized to meet the requirements of a particular application.

Figure 6:
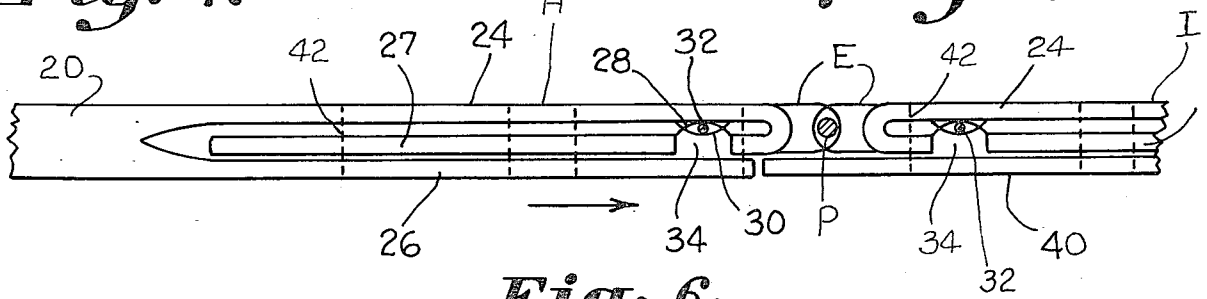
FIG. 6 is a schematic elevation of the dryer fabric of FIG. 5 folded and joined to form a pintle loop seam according to the invention.

A similar construction for seam member I, of course, is made at the opposing end of the dryer felt illustrated schematically in FIG. 6 in which the first ply extension 24 is folded to provide the intermediate layer 27 and a second woven ply extension illustrated at 40 is woven in the same manner as 26 but is somewhat extended in length. The lease yarn hinge joint is again indicated at 34. The paper carrying side of the fabric and seams is the same as ply 24.

In one application, as illustrated in FIG. 6, the second ply extension 26 was woven to terminate short of the pintle receiving loops E and the second woven ply extension 40 of the opposing end of the dryer felt was made to extend under the pintle receiving loops of the connected seam members to protect the seam during travel around the rollers of the papermaking machine. The belt so designed in FIG. 6, would travel from left to right so that the joint between the second, lower woven ply extensions 26 and 40 would be trailing the pintle seam connection.

In manufacturing the dryer felt illustrated, a conventional doby loom may be used to weave the belting fabric 20 from a desired yarn. At the commencement of the weaving operation a suitable pattern chain is used to weave a short section of fabric 20. The pattern chain is then changed to control the harness motion to weave a short length of the ply extensions 24 and 26 in the form of a tubular fabric as illustrated at single ply layer 24*a* and 26*a*. The loop warps 28 and 30 are held in separate harnesses and are introduced in the first short section of fabric 20 which is later cut off. The warps are brought out as illustrated in FIG. 5. The floating of the loop warps in the designated areas may be achieved utilizing conventional weaving techniques. The loom is then stopped and the pattern chain changed to weave the main body of the felt fabric 20 to a predetermined length of belting of the weave pattern specified. When a belt of the desired length is achieved the loom is stopped and the pattern chain is changed back to weave the woven ply extensions 24 and 40 of seam member I again weaving the loop warps in and out as described above. The second ply extensions 26 and 40 may be trimmed off as desired for the application being made.

In the form of the invention shown in FIG. 5, a conventional dobby loom having ten harnesses was utilized wherein four of the harnesses may be utilized to hold the regular warps 23 as woven in each of the upper and lower ply extensions. All eight of the harnesses may be utilized to weave the main length of fabric 20. The special warp strands 28 and 30 may be held in the ninth and tenth harnesses.

In one particular construction, a dryer felt fifty-two yards in length and three hundred fifty-six inches in width was constructed on a wide fabric doby loom utilizing a reed four hundred inches in width having eight dents per inch in which five warp ends were drawn in through each dent together with one of the loop warps 28 and 30.

It has been found that fine grade paper may be advantageously manufactured by utilizing a dryer felt fabric and seam according to the invention wherein the main body portion 20 and seam members H and I have a uniform thickness so that bumping and separation of the paper as the seam goes around the rollers is substantially reduced. This may be carried out by utilizing smaller filling yarns 24*a* and 26*a* in the woven ply extensions 24 and 26 such that when the first ply extension 24 is folded back to form the pintle receiving loops, the resulting seam member H is essentially the same thickness as the belting fabric 20.

Figure 9:
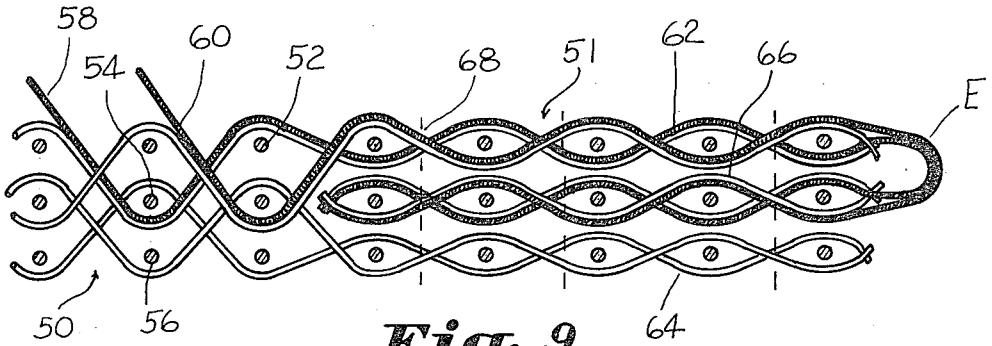
FIG. 9 is an enlarged elevation of a woven dryer felt fabric and seam illustrating an alternate three-ply construction according to the invention.
Figure 8:
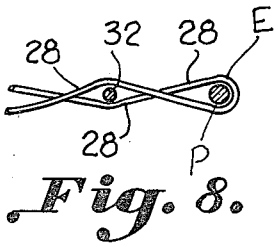
FIG. 8 is a schematic elevation illustrating the leasing of the floated warps of the hinge section illustrated in FIG. 7.
Figure 7:
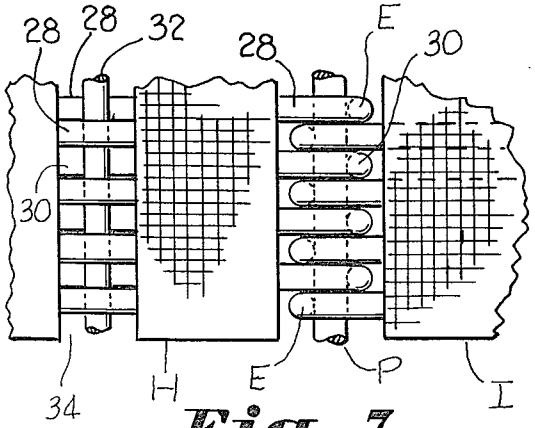
FIG. 7 is a schematic bottom plan of the folded portion of the dryer fabric seam, with the lower ply extension omitted, illustrating the seam and hinge which secures the folded portion.

FIG. 9 illustrates another embodiment of the invention where the fabric belting portion 50 and the seam member 51 may be made uniform in thickness wherein the belting fabric is constructed as a three ply fabric having a first ply 52, a second ply 54, and a third ply 56. In this instance, the filling yarns of the belting fabric and seam member are the same. Special warps 58 and 60 are utilized to form the pintle receiving loops E. A pair of superposed separable woven ply extensions 62 and 64 are provided wherein the first woven ply extension 62 is folded upon itself to define a folded portion 66 sandwiched between the first and second woven ply extensions and which forms the pintle receiving loops in a manner similar to the seam of FIG. 5. In this embodiment, yarn stitching is illustrated as securing the woven ply 62 64, and 66 together at 68. This construction is particularly advantageous for protecting the pintle loops E since a full three ply construction is had in the seam and fabric sections cushioning the opposite paper carrying side and the pintle seam loops from the metal rolls which often become pitted and rough. Likewise, the three ply construction provides a bottom cushion layer opposite the paper carrying side. This dryer fabric and seam may be woven on a conventional doby loom in a similar manner as that previously described.

While a preferred embodiment of the invention has been described using specific terms, such description is for illustrative purposes only, and it is to be understood that changes and variations may be made without departing from the spirit or scope of the following claims.

What is claimed is:

1. A woven multiply dryer fabric and pintle hinge seam for joining the opposing ends of a woven dryer fabric and the like, comprising:

a pair of separated superposed continuously woven ply extensions formed at each end of said fabric opening at a free outer edge thereof;

a seam webbing member inserted between each pair of said woven ply extensions at each end of said fabric;

a row of spaced aligned loops carried by each said seam webbing member and extending outwardly of a free edge thereof;

means securing said woven ply extensions at each end of said fabric to said seam webbing member inserted therebetween; and said woven ply extensions at each end of said felt fabric tapering outwardly toward said spaced aligned loops, and having outer ends lying substantially flush with said aligned loops providing minimum interruption in the surface of the joint between said opposing ends of said fabric.

2. A woven fabric and seam for joining the opposing ends of a length of woven multiply dryer fabric and the like belting comprising:

a pair of separated superposed woven ply extensions continuously woven from each opposing end of said length of belting, said woven ply extensions opening at a free outer edge thereof;

a seam webbing member inserted between each pair of said woven ply extensions at each end of said belting;

said seam webbing member at one end of the length of said belting having connection with said beam webbing member at the other end of said length of multiply belting; and means securing said woven ply extensions at each end of the belting to said seam webbing member inserted therebetween.

3. The structure set forth in claim 2 wherein said seam webbing member includes a first woven ply extension of each said pair being folded back upon itself between said woven ply extensions and includes loop forming means constructed intermediate the ends thereof which forms a row of spaced pintle receiving loops across said first ply extension at the fold-line thereof.

4. The structure set forth in claim 2 wherein said seam webbing member includes a separate fabric member inserted between said woven ply extensions having spaced loops carried at a free edge thereof.

5. The method of constructing and joining woven multiply dryer fabric and the like comprising the steps of:

weaving a separable pair of outer superposed ply extensions opening at a free outer first edge of said fabric;

weaving a predetermined length of multiply fabric continuously from said pair of ply extensions;

weaving a separable pair of outer superposed ply extensions opening at a free outer second edge of said fabric opposite said first edge;

separating said ply extensions and inserting a seam webbing member between said woven ply extensions at each end of said fabric; and joining said pair of woven ply extensions at each end of the fabric and said seam webbing member sandwiched therebetween.

6. The method set forth in claim 5 including weaving said fabric in at least a three-ply construction and omitting a middle ply of said three-ply fabric between said pair of outer superposed ply extensions when weaving said superposed ply extensions.

7. The method set forth in claim 5 including weaving said fabric in a two-ply construction and severing the binder threads between the plys of said two-ply fabric at said first and second edges for separating said ply extensions.

8. The method set forth in claim 5 wherein joining said woven ply extensions at each end of the fabric to said seam webbing member includes stitching a plurality of spaced transverse rows of stitching at each end of the fabric.

9. The method set forth in claim 8 including joining seam webbing at each end of the fabric by applying aligned loops and inserting pintle material therein.

10. The method of claim 5 wherein said seam webbing member is provided by an extended portion of a first of said outer ply extensions of each said pair folded upon itself and includes constructing loop forming means in said first ply extension intermediate the ends thereof which provide spaced aligned loops across said first ply extension when folded.

11. The method of claim 5 wherein said seam webbing member is provided by a separate fabric member having spaced aligned loops carried at a free edge thereof.

12. A woven multiply dryer fabric and seam and the like for use on papermaking machinery comprising:

a length of woven multiply belting fabric woven from a plurality of warp and filling strands;

first and second separated superposed continuously woven ply extensions woven at each end of said belting fabric opening at a free outer edge thereof;

loop forming means formed across said first ply extension intermediate the ends thereof;

a row of spaced pintle receiving loops defined by said first ply extension being folded upon itself about said loop forming means; and means securing said first ply extension in said folded position.

13. The structure as set forth in claim 12 wherein said loop forming means include a number of warp strands floated out of the weave of said first woven ply extension at said intermediate portion which form said row of spaced loops.

14. The structure set forth in claim 12 including hinge means formed adjacent said row of spaced loops by which said folded portion of said first ply extension is secured to an unfolded portion thereof affording lateral and longitudinal flexibility to said dryer fabric seam.

15. The structure set forth in claim 12 including a pair of longitudinally spaced areas wherein a number of previously woven warp strands are floated out of the weave of said first ply extension, said pair of spaced areas overlying one another when said first ply extension is folded upon itself affording interconnection of said floated warp strands securing said first ply extension in said folded position.

16. The structure set forth in claim 12 wherein said folded portion of said first ply extension is secured by stitching between said first and second ply extensions.

17. The structure set forth in claim 15 including a lease strand interwoven over and under said overlying warp strands for interconnecting said strands.

18. The structure set forth in claim 13 wherein said number of warp strands have a higher tensile strength than the strands of said plurality of warp strands woven in said multiply belting fabric and woven ply extensions.

19. The structure set forth in claim 12 including means fastening said first and second ply extensions.

20. A method of weaving and constructing dryer fabric and seams for joining the ends thereof to provide endless dryer fabric belting and the like, comprising:

weaving a first separable pair of outer superposed ply extensions opening at a free outer first edge of said belting;

weaving a predetermined length of multiply belting fabric continuously from said outer ply extensions;

weaving a second separable pair of outer superposed ply extensions opening at a free outer second edge of said belting opposite said first edge;

providing loop forming means in a first of said superposed ply extensions of each pair intermediate the ends thereof;

folding each said first ply extension upon itself causing said loop forming means to form a row of spaced aligned loops across said first ply extensions at the fold-line thereof;

securing each said first woven ply extension in said folded position; and said spaced loops at said opposite ends of said length of belting fabric having seam connection with one another.

21. The method of claim 20 wherein said folded portion of said first ply extension is folded between the second ply extension of each pair and the remaining portion of said first ply extension.

22. The method set forth in claim 20 including securing said first ply extension and said folded portion thereof together by a hinge means affording a degree of lateral and longitudinal flexibility to said seam connection.

* * * * *